US011180270B2

(12) United States Patent
Persson et al.

(10) Patent No.: US 11,180,270 B2
(45) Date of Patent: Nov. 23, 2021

(54) DEVICE AND METHOD FOR ALIGNING A CARTON BLANK

(71) Applicant: Tetra Laval Holdings & Finance S.A., Pully (CH)

(72) Inventors: Richard Persson, Häljarp (SE); Lars Carlsson, Lund (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 16/466,338

(22) PCT Filed: Nov. 23, 2017

(86) PCT No.: PCT/EP2017/080197
§ 371 (c)(1),
(2) Date: Jun. 4, 2019

(87) PCT Pub. No.: WO2018/104064
PCT Pub. Date: Jun. 14, 2018

(65) Prior Publication Data

US 2019/0337657 A1 Nov. 7, 2019

(30) Foreign Application Priority Data

Dec. 5, 2016 (EP) ..... 16202178

(51) Int. Cl.
*B65B 43/48* (2006.01)
*B65H 1/02* (2006.01)
(Continued)

(52) U.S. Cl.
CPC ..... *B65B 43/48* (2013.01); *B65H 1/02* (2013.01); *B65H 3/66* (2013.01); *B65H 9/101* (2013.01);
(Continued)

(58) Field of Classification Search
CPC ..... B65B 43/48; B65H 3/66; B65H 9/101; B65H 2301/422; B65H 2404/72
See application file for complete search history.

(56) References Cited

U.S. PATENT DOCUMENTS 1,787,077 A * 12/1930 Kruse ..... B65H 3/60 271/102
2,378,306 A * 6/1945 Leonhart ..... B65H 3/56 271/165
(Continued)

FOREIGN PATENT DOCUMENTS

DE 2939267 A1 4/1981
EP 3075688 A1 10/2016
(Continued)

OTHER PUBLICATIONS

International Search Report in corresponding PCT Application No. PCT/EP2017/080197 dated Feb. 26, 2018 (2 pages).
(Continued)

*Primary Examiner* — Thanh K Truong
*Assistant Examiner* — David G Shutty
(74) *Attorney, Agent, or Firm* — Finnegan, Henderson, Farabow, Garrett & Dunner, LLP

(57) ABSTRACT

An infeed alignment device (10) for aligning a carton blank (14) such that a picking device can pick the carton blank. The infeed alignment device comprises an upper alignment member (11) for pushing on an upper part of the carton blank, a lower alignment member (12) for pushing on a lower part of the carton blank, and wherein the upper and/or lower alignment member is configured to push in a push direction on the top and/or the bottom of the carton blank such that the carton blank is in a picking position for the picking device.

2 Claims, 5 Drawing Sheets

(51) Int. Cl.
*B65H 3/66* (2006.01)
*B65H 9/10* (2006.01)

(52) U.S. Cl.
CPC .. *B65H 2301/4222* (2013.01); *B65H 2404/72* (2013.01); *B65H 2701/1766* (2013.01)

(56) References Cited

U.S. PATENT DOCUMENTS 2,626,147 A * 1/1953 Gjostein ..... B65H 3/62 271/8.1
3,385,457 A * 5/1968 Zinn ..... B65G 57/11 414/789.1
3,429,570 A * 2/1969 Scully ..... B65B 43/185 271/12
3,693,970 A * 9/1972 Grobman ..... B65H 3/66 271/240
4,854,569 A * 8/1989 Mizuta ..... B65H 3/0816 271/98
4,921,237 A * 5/1990 Nubson ..... B65H 1/02 271/104
5,211,529 A * 5/1993 Esala ..... B65H 1/30 271/150
5,288,064 A * 2/1994 Manabe ..... B65H 3/66 271/117
5,407,187 A * 4/1995 Reil ..... B65H 3/085 271/102
5,547,336 A * 8/1996 Whiteman ..... B65G 59/062 271/105
5,941,681 A * 8/1999 Piotrowski ..... B65H 1/06 414/797.8
5,970,834 A * 10/1999 Garofano ..... B65B 43/145 29/426.3
6,682,065 B2 * 1/2004 Leonardo ..... B65B 41/06 271/104
7,367,445 B2 * 5/2008 Mazurek ..... B65H 1/30 198/777
7,644,916 B2 * 1/2010 Spatafora ..... B65H 3/34 271/101
9,296,577 B2 * 3/2016 Hopner ..... B65H 3/24
10,532,901 B2 * 1/2020 Lassen ..... B65H 3/0808
2003/0061913 A1 * 4/2003 Marquardt ..... B25B 21/002 81/57.3
2007/0001363 A1 1/2007 Flagg
2016/0052222 A1 * 2/2016 Kinney ..... B65D 5/2057 229/126

FOREIGN PATENT DOCUMENTS

WO WO 2012/082048 A1 6/2012
WO WO-2012082048 A1 * 6/2012 ..... B65H 3/0808

OTHER PUBLICATIONS

European Search Report in corresponding European Application No. 16202178.6 dated Jun. 16, 2017 (9 pages).

* cited by examiner

DEVICE AND METHOD FOR ALIGNING A CARTON BLANK

CROSS-REFERENCE TO RELATED PATENT APPLICATIONS

This is a National Phase of International Application No. PCT/EP2017/080197, filed Nov. 23, 2017, which claims the benefit of European Application No. 16202178.6 filed Dec. 5, 2016. The entire contents of the above-referenced applications are expressly incorporated herein by reference.

TECHNICAL FIELD

The present disclosure relates to the field of infeed devices, particularly to an infeed alignment device for a picking device in a filling machine.

BACKGROUND

When producing carton packages a filling machine for folding and filling a substance such as a liquid or semi-liquid is used. The filling machine can use different types of base materials and shape of the base material. A type of package is produced by using carton blanks as the base shape which is then folded and filed with a desired substance. These carton blanks are normally made elsewhere and shipped in boxes to a location of the filling machine so that they can be loaded into the machine by an infeed device. Since the carton blanks are made somewhere else and shipped to the location of the filling machine it is not always the same batch that is used one after the other but more normally an operator just loads the next stacked carton blank box that is on a pallet. It is also so that inside the box the carton blanks can somewhat move and thus be shifted around. There is also a tolerance of how much variation each blank can have as a width and a height. Today these factors are handled by an operator standing by the infeed device and filling machine to visually check so that the carton blanks are loaded correctly in the infeed device and distributed to the filing machine. The distribution to the filing machine from the infeed device is in a quite high speed of at least a few blanks per second so the accuracy of the position of the blanks are of high importance. And, if something goes wrong the operator need to push the carton blanks into place or align them in the infeed device so that the filing machine is able to use the blanks. This is time consuming and stops the running of the filing machine in an unwanted way.

Hence, an improved infeed alignment device which solves at least some or all of the above drawbacks is desired.

SUMMARY OF THE INVENTION

It is an object of the present inventive concept to mitigate, alleviate, or eliminate one or more of the above-identified deficiencies in the art and disadvantages singly or in combination.

According to a first aspect of the inventive concept, an infeed alignment device for aligning a carton blank such that a picking device can pick the carton blank comprising an upper alignment member for pushing on an upper part of the carton blank, a lower alignment member for pushing on a lower part of the carton blank, and wherein the upper and/or lower alignment member is configured to push in a push direction on the top and/or the bottom of the carton blank such that the carton blank is in a picking position for the picking device.

According to a second aspect of the inventive concept, a method of aligning a carton blank such that a picking device can pick the carton blank, comprising, providing an infeed alignment device. Aligning an upper part of the carton blank by an upper alignment member and/or aligning a lower part of the carton blank by a lower alignment member, and wherein the aligning is performed by the upper and/or lower alignment member pushing on the top and/or bottom of the carton blank in a pushing direction.

Further examples of the disclosure are defined in the dependent claims, wherein features for the third and subsequent aspects of the disclosure are as for the first to second aspects mutatis mutandis.

Some examples of the disclosure provide for pushing on the upper and/or lower part of a carton blank.

Some examples of the disclosure provide for adjusting a carton blank at two locations, respectively.

Some examples of the disclosure provide for carton blank to easily be pushed into a correct entry position by use of a low force.

Some examples of the disclosure provide for that a carton blank is in a correct position and can be picked at a desired time.

Some examples of the disclosure provide for a carton blank to be pushed at both a top and a bottom to prevent any tilting of the carton blank.

Some examples of the disclosure provide for an upper and a lower alignment member to be moved opposite to a pushing direction of a blank.

Some examples of the disclosure provide for an external force to be applied to a push member.

Some examples of the disclosure provide for an infeed alignment device being connected to a picking device.

Some examples of the disclosure provide for an infeed alignment device to be synchronized with a picking device.

Some examples of the disclosure provide for a carton blank to be in a correct position at a time when a picking device is ready to pick the carton blank.

Some examples of the disclosure provide for an infeed alignment device to not push on any carton blank when a picking device picks the carton blank.

Some examples of the disclosure provide for a reliable connection.

Some examples of the disclosure provide for a more robust, fail safe connection.

Some examples of the disclosure provide for an upper and lower alignment member being biased in a direction opposite to a pushing direction.

Some examples of the disclosure provide for an upper and lower alignment member being pushed at a same time.

BRIEF DESCRIPTION OF THE DRAWINGS

The above, as well as additional objects, features and advantages of the present invention/inventive concept, will be better understood through the following illustrative and non-limiting detailed description of different embodiments of the present invention/inventive concept, with reference to the appended drawings, wherein.

DETAILED DESCRIPTION

Figure 1:
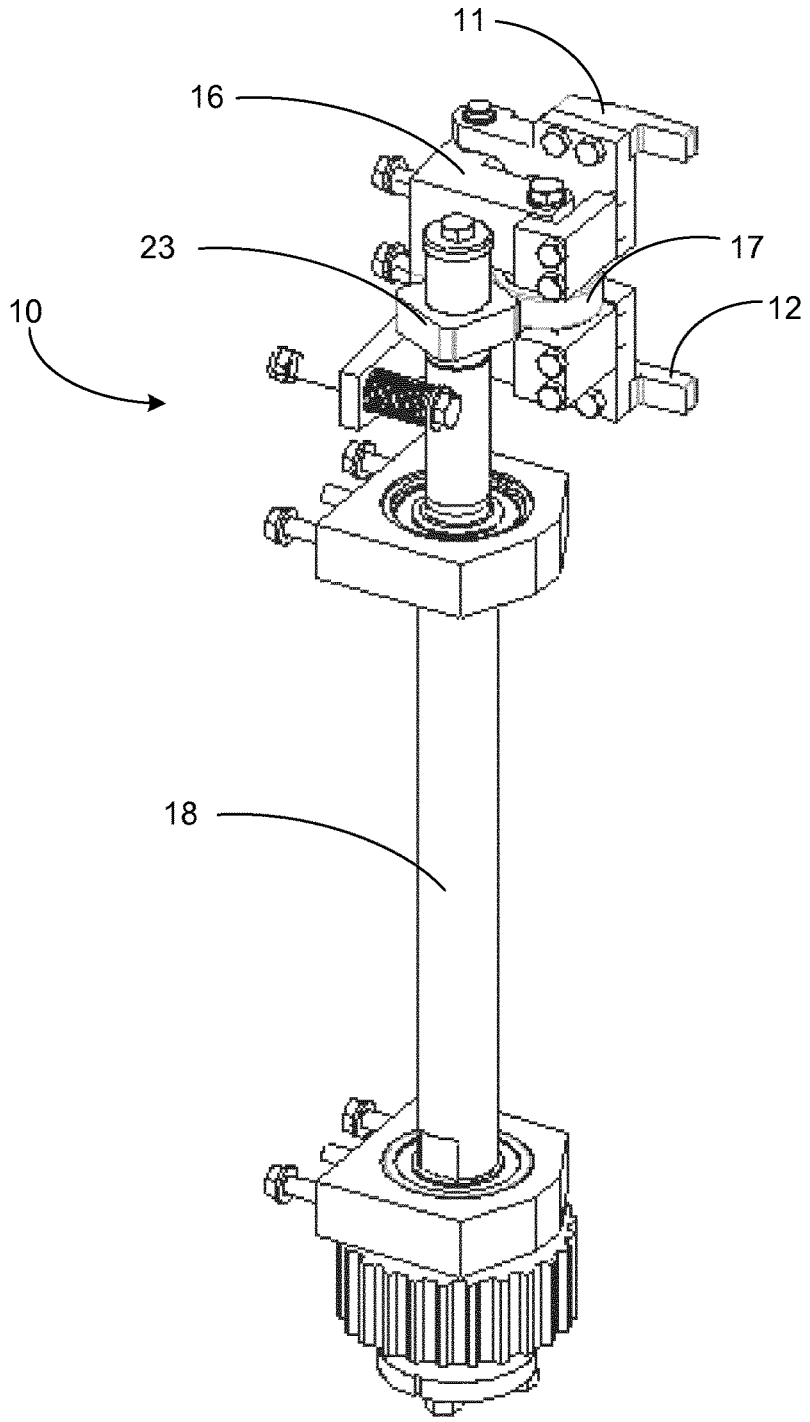
FIG. 1 illustrates a perspective view of an infeed alignment device.

FIG. 1 illustrates an example of an infeed alignment device 10 for aligning a carton blank such that a picking device can pick the carton blank. The infeed alignment device 10 comprises an upper alignment member 11 for pushing on an upper part of the carton blank and a lower alignment member 12 for pushing on a lower part of the carton blank. And, the upper 11 and/or lower 12 alignment member is configured to push in a push direction on the top and/or the bottom of the carton blank such that the carton blank is in a correct entry position for the picking device. By having the upper 11 and/or lower 12 alignment member pushing on the upper and/or lower part of the carton blank the infeed device 10 can adjust the carton blank at two locations, respectively.

Figure 4:
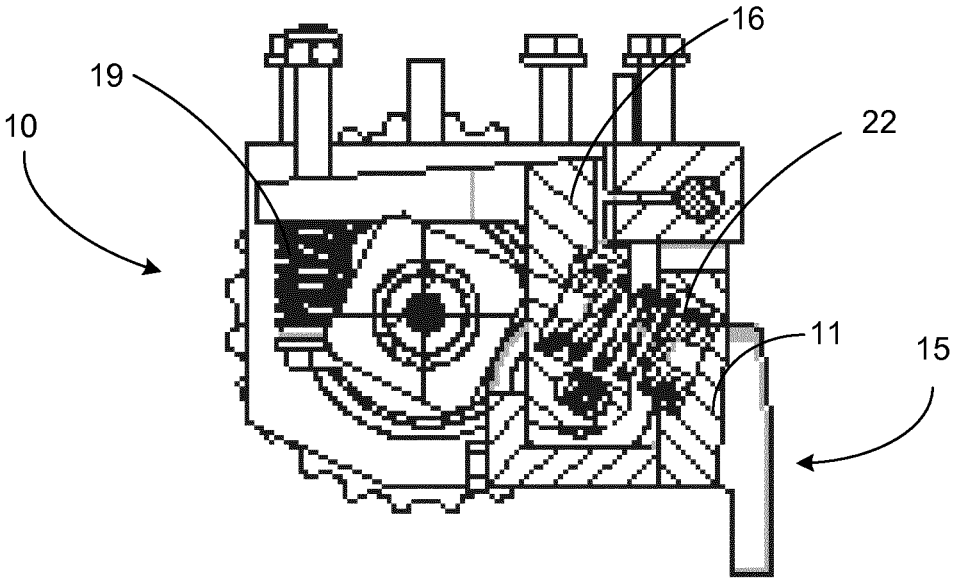
FIG. 4 illustrates a top view of an infeed alignment device.
Figure 5:
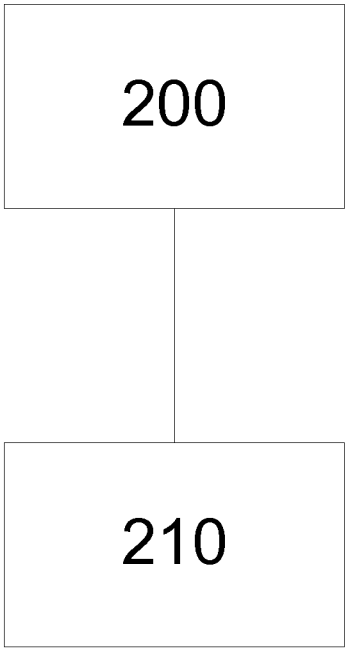
FIG. 5 is a flow diagram of a method of using an infeed alignment device.

In an example, illustrated in e.g. FIG. 4, the upper and/or lower alignment member 11, 12 comprises an inclined pushing surface 15. By the upper and/or lower alignment members 11, 12 having the inclined surface 15 the carton blank(s) 14 will easily be pushed into the correct entry position by use of a low force. Because, if the force is too high due to the need of pushing the carton blank(s) 14 a large distance, disturbances in the other blanks in front and behind is affected negatively and will be moved out of place. Thus this could counter act the desire to put the carton blank in a correct position.

In an example, illustrated in e.g. FIG. 4, the upper and/or lower alignment member 11, 12 is biased toward a center of the infeed device 10. By having the upper and/or lower alignment members 11, 12 biased toward a center of the infeed device 10 this assures that the carton blanks are in a correct position and can be picked at the desired time. In an example, the upper and lower alignment members 11, 12 are biased differently. In an example, the upper and/or lower alignment members 11, 12 are biased outward from the center of the infeed device 10. In examples, the bias is performed by a spring 19, materials having an elastic deformation or other types of mechanisms which are flexible and can return to an original position after being moved away from it.

Figure 2:
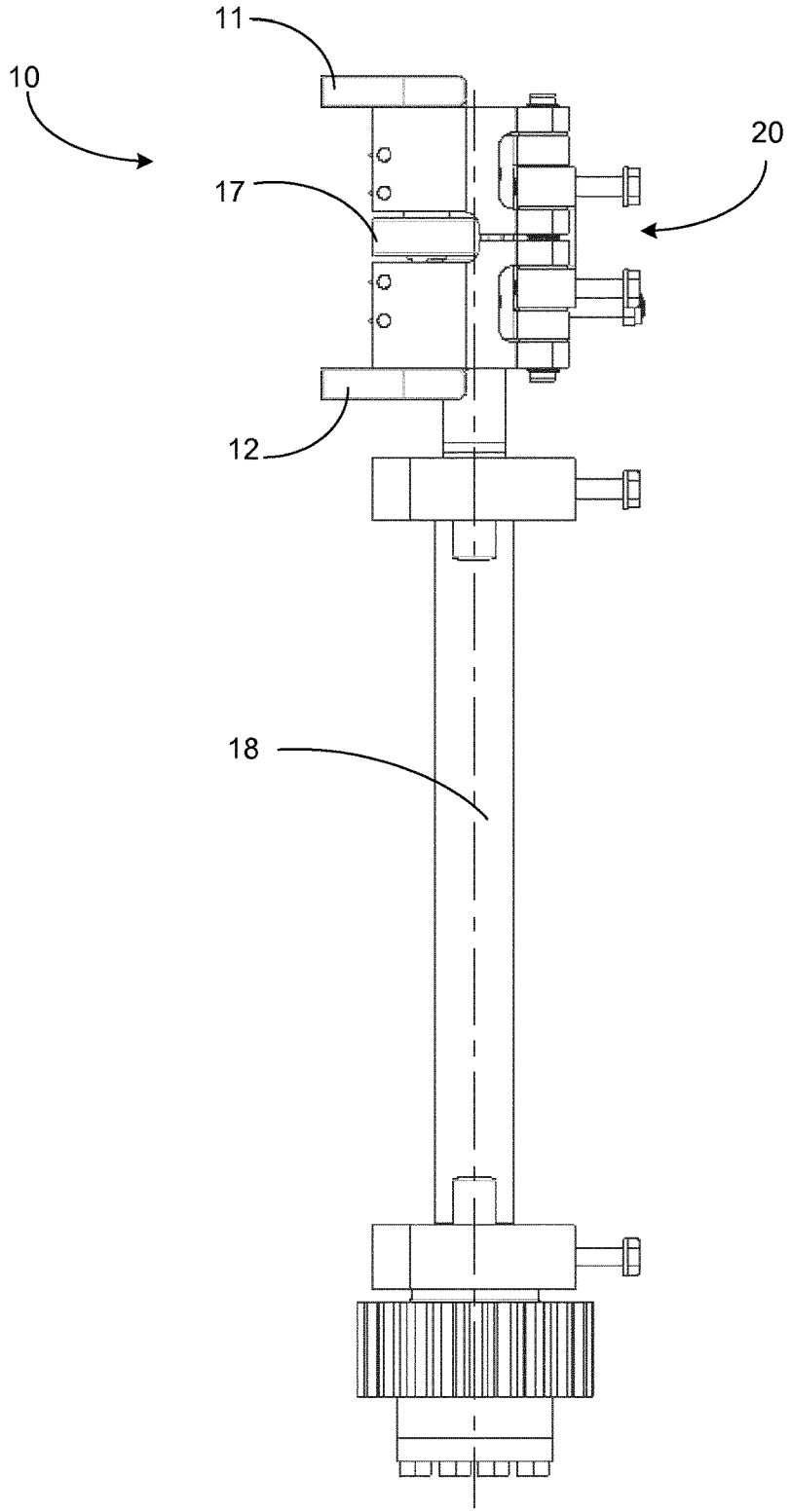
FIG. 2 illustrates a side view of an infeed alignment device.

In an example, illustrated in e.g. FIG. 2, the upper and lower alignment members 11, 12 are mechanically connected 20 and configured to push at the same time. By mechanically connecting 20 the upper and lower alignment members 11, 12 and configuring them to push at the same time the carton blank will be pushed at both the top and bottom which will prevent any tilting of the carton blank and thus be arranged in the desired picking position.

In an example, illustrated in e.g. FIG. 1, the mechanical connection 20 comprises a push member 16 configured to push on both the upper and lower alignment members 11, 12 in the push direction of the blanks. By using the push member 16, the upper and lower alignment members 11, 12 are mechanically connected but at the same time they can be moved in the push direction of the blanks. In an example, the mechanical connection 20 further comprises a pivot mechanism, such as a pin, screw and so on, so that the push member 16 and the upper and/or lower alignment members 11, 12 are mechanically connected and can pivot relative to each other, as can be seen in e.g. FIGS. 1 and 2.

Figure 3:
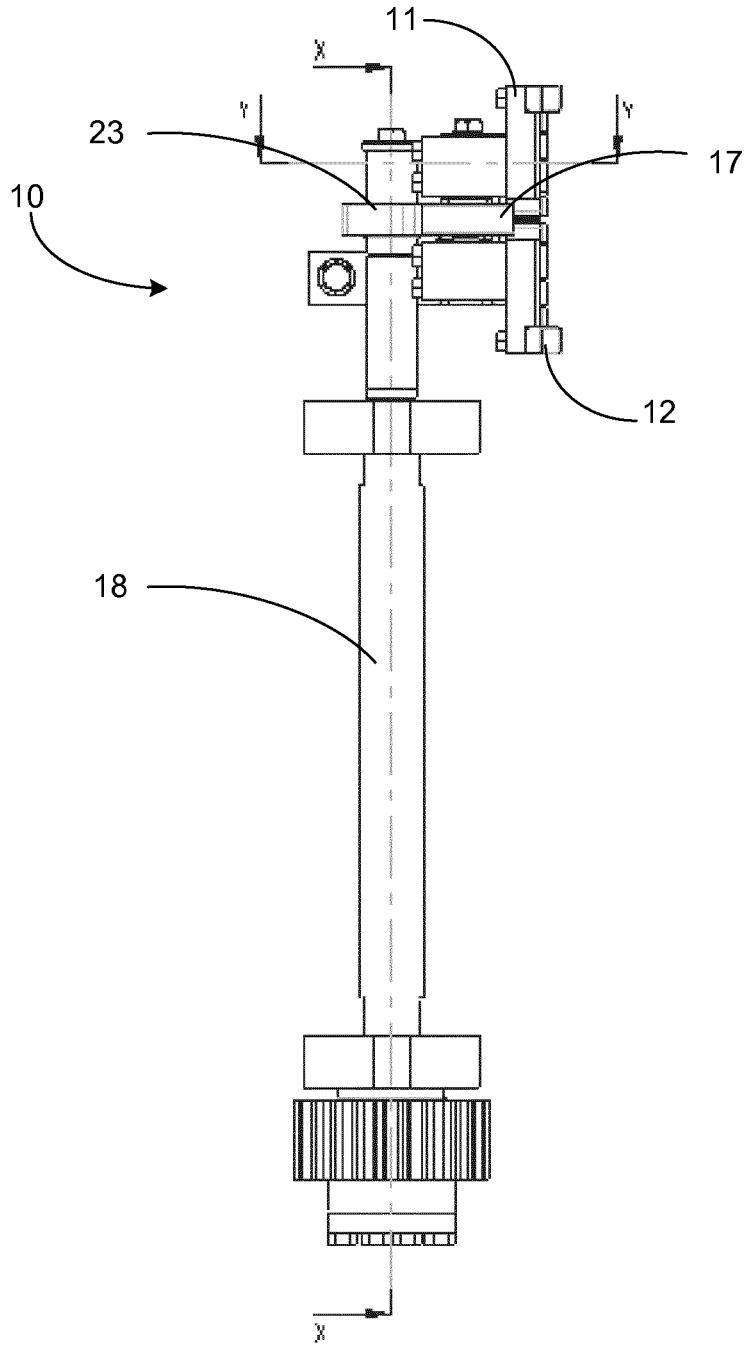
FIG. 3 illustrates another side view of an infeed alignment device.

In an example, illustrated in e.g. FIGS. 1-3, the pushing member 16 comprises a circular member 17 configured to be pushed at such that the circular member 17 in turn affects the push member 16 to be pushed in the push direction of the blank. By having the circular member 17 an external force can be applied to the push member 16 in the pushing direction of the blanks such that the upper and/or lower alignment members 11, 12 push on the blanks. In an example, a rotating member 23 pushes on the circular member 17.

In an example illustrated in e.g. FIG. 4, the upper and/or lower alignment members 11, 12 is further biased away from a center of the infeed device by an alignment biasing member 22. By biasing the upper and/or lower alignment members 11, 12 they will push with a force that can be regulated so that they will not push with a too high force and damage any blank when arranging the blank in the desired position. In an example, the alignment biasing member is a spring or any other mechanism that can is capable of regulating a force. Also illustrated in FIG. 4 is that the alignment biasing member 22 is connected to both the pushing member 16 and the upper alignment member 11. The lower alignment member 12 is connected in the same way to the pushing member 16.

In an example, the infeed alignment device 10 is connected to the picking device. By connecting the infeed alignment device 10 to the picking device, the infeed alignment device 10 is synchronized with the picking device. This allows the infeed alignment device 10 to have the carton blanks in the correct position at the time when the picking device is ready to pick the carton blank. It further allows the infeed alignment device 10 to be synchronized such that is will not push on any blanks when the picking device picks the carton blank so it can easily pick it.

In an example, the connection between the infeed alignment device 10 and the picking device is a mechanical connection 18. By using the mechanical connection the reliability of the connection is simple, robust, fail safe and will move when the mechanics of the picking device will move. In an example, the mechanical connection 18 comprises a rod having a cog wheel that is configured to be connected to a similar connection from the picking device such that they are mechanically connected. In an example, the rotating member 23 is a part of the mechanical connection 18 or connected to it.

In an example, the connection is an electrical connection which synchronizes the infeed alignment device 10 and the picking device to perform any operations at the desired time. In an example, a filing machine comprises the infeed alignment device 10 and/or the picking device.

An exemplary way of aligning the carton blanks will be described below. Such a way comprises aligning the carton blank such that a picking device can pick the carton blank by aligning 200 the upper part of the carton blank by the upper alignment member 11. It further comprises aligning 210 the lower part of the carton blank by the lower alignment member 12, and wherein the alignment is performed by the upper and/or lower alignment members 11, 12 pushing on the top and/or bottom of the carton blank in the pushing direction.

In an example, the upper and lower alignment members 11, 12 are biased in a direction opposite to the pushing direction.

In an example, the upper and lower alignment members 11, 12 are pushed at the same time.

In example, the push member 16 is pushed such that it pushes on both the upper and lower alignment members 11, 12 opposite to the push direction.

In an example, the push member 16 comprises the circular member 17 and the circular member 17 is moved such that the circular member 17 in turn affects the push member 16 to push on the upper and lower alignment members 11, 12 in the push direction.

In an example, the infeed alignment device 10 is synchronized with the picking device. In an example, the synchronization is performed by a mechanical connection.

From the description above follows that, although various embodiments of the invention have been described and shown, the invention is not restricted thereto, but may also be embodied in other ways within the scope of the subject-matter defined in the appended claims.

The invention claimed is:

1. An infeed alignment device comprising:

an upper alignment member configured to push in a pushing direction; and a lower alignment member configured to push in the pushing direction, wherein the upper alignment member and the lower alignment member are mechanically connected and configured to push in the pushing direction at the same time, wherein a mechanical connection between the upper alignment member and the lower alignment member includes a push member configured to push on both the upper alignment member and the lower alignment member in the pushing direction, and wherein the push member includes a circular member configured to be pushed such that the circular member causes the push member to push on the upper alignment member and the lower alignment member in the pushing direction, wherein at least one of the upper alignment member or the lower alignment member is biased outward from a center of the infeed alignment device by a spring.

2. An infeed alignment device according to claim 1, wherein at least one of the upper alignment member or the lower alignment member includes an inclined pushing surface.

* * * * *